US006379477B1

(12) United States Patent
Ono

(10) Patent No.: US 6,379,477 B1
(45) Date of Patent: Apr. 30, 2002

(54) FE-CR-NI ALLOY FOR ELECTRON GUN ELECTRODES AND FE-CR-NI ALLOY SHEET FOR ELECTRON GUN ELECTRODES

(75) Inventor: Toshiyuki Ono, Kanagawa (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 0 days.

(21) Appl. No.: 09/640,396

(22) Filed: Aug. 17, 2000

(30) Foreign Application Priority Data

Sep. 28, 1999 (JP) ..... 11-274901
Jun. 26, 2000 (JP) ..... 2000-191156

(51) Int. Cl.[7] ..... C22C 38/40; C22C 38/44; C22C 38/46; C22C 38/48

(52) U.S. Cl. ..... 148/327; 148/325; 148/326; 420/43; 420/44; 420/45; 420/62; 420/94; 420/97

(58) Field of Search ..... 148/325, 327, 148/336; 420/43, 44, 45, 62, 94, 97

(56) References Cited

U.S. PATENT DOCUMENTS 5,098,652 A * 3/1992 Yasui et al. ..... 420/45
5,496,514 A * 3/1996 Yamauchi et al. ..... 420/34

FOREIGN PATENT DOCUMENTS

| | | | | |
|---|---|---|---|---|
| JP | 56096052 | * | 8/1981 | |
| JP | 60075551 | * | 4/1985 | |
| JP | 59182956 | * | 10/1994 | |
| JP | 8-092691 | | 4/1996 | |
| JP | 10-030157 | | 2/1998 | |
| JP | 11-106873 | | 4/1999 | |
| JP | 11-323502 A | * | 11/1999 | ..... C22C/38/00 |

* cited by examiner

*Primary Examiner*—Roy King
*Assistant Examiner*—Harry D. Wilkins, III
(74) *Attorney, Agent, or Firm*—Arent Fox Kintner Plotkin & Kahn, PLLC

(57) ABSTRACT

An Fe—Cr—Ni alloy for electron gun electrodes, comprises: 15 to 20% Cr; 9 to 15% Ni; 0.12% or less C; 0.005 to 1.0% Si; 0.005 to 2.5% Mn; 0.03% or less P; 0.0003 to 0.0100% S; 2.0% or less Mo; 0.001 to 0.2% Al; 0.003% or less O; 0.1% or less N; 0.1% or less Ti; 0.1% or less Nb; 0.1% or less V; 0.1% or less Zr; 0.05% or less Ca; 0.02% or less Mg by weight; balance Fe; and inevitable impurities. When the alloy is rolled into a sheet with a thickness in the range of 0.1 to 0.7 mm, the surface portion of the sheet includes groups of lining inclusions. The number of groups with widths of 10 $\mu$m or more and less than 20 $\mu$m and with lengths of 20 $\mu$m or more is 20/mm$^2$ or less, and the number of groups with widths of 20 $\mu$m or more and with lengths of 20 $\mu$m or more is 5/mm$^2$ or less.

6 Claims, 2 Drawing Sheets

FE-CR-NI ALLOY FOR ELECTRON GUN ELECTRODES AND FE-CR-NI ALLOY SHEET FOR ELECTRON GUN ELECTRODES

BACKGROUND OF THE INVENTION

This invention relates to an Fe—Cr—Ni alloy which is required to be nonmagnetic and is used in electron gun electrodes, and specifically relates to an Fe—Cr—Ni alloy for electron gun electrodes and Fe—Cr—Ni alloy sheet for electron gun electrodes made therefrom, with improved press forming properties for drawing.

In general, electron gun electrodes used in color cathode ray tubes and the like are produced by drawing a nonmagnetic Fe—Cr—Ni stainless steel material with a thickness of 0.1 to 0.7 mm into a predetermined shape using press forming. In order to improve the drawing properties, in particular, to facilitate burring (working in which a circular hole is formed and the circumference thereof is cylindrically projected), improvement in degree of rolling reduction and annealing conditions has been proposed in Japanese Patent Application, First Publication, No. 257253/94. Japanese Patent Application, First Publication, No. 205453/96 proposes a method in which press forming properties are improved by limiting center-line mean roughness and the maximum height of surface roughness in press forming using a low viscosity lubricating oil, which is easy to be removed by degreasing and has been used to increase production efficiency. Japanese Patent Application No. 283039/97 demonstrates that burrs remaining in press punching a through hole relates to cracks in burring, and proposes a method in which burring properties are improved by suitable amounts of S being contained to improve punching properties and in which minute amounts of the elements are controlled to improve the drawing properties.

According to the rapid advances for finer and brighter cathode ray tubes for computers in recent years, requirements on focusing characteristics of the electron guns has become more severe. Therefore, the requirements on materials requires not only high precision formability for the large diameter lens electrodes but also good formability for high speed press forming. However, the prior art alloys have not been adequate since cracks occur at drawing surfaces.

BRIEF SUMMARY OF THE INVENTION

The present invention has been made to respond to the above situation. An object of the invention is to provide an Fe—Cr—Ni alloy for electron gun electrodes, having superior drawing properties, which have been more severe in recent years, in particular, which can inhibit the occurrence of cracks in drawing.

The inventors have intensively researched the surface conditions of materials to solve the problems. As a result, the inventors have found that the drawing properties are influenced by the size and the number of groups of inclusions existing in a surface layer of a material. In particular, they have found that in groups of inclusions (including single inclusion) existing in a surface layer, ones with certain size or more influence the occurrence of cracks in drawing, and they have been able to inhibit the occurrence of cracks by reducing these inclusions. FIG. 1 is a diagram showing the relationship between the number of groups of inclusions existing in a surface layer of an Fe—Cr—Ni alloy with a thickness of 0.6 mm and the incidence of cracks. It should be noted that the incidence of cracks was obtained by sampling 200 pieces at random from 2000 pieces of punched samples for inspection.

That is, the groups of inclusions were classified by the width and the length of the groups of widths of 5 $\mu$m or more and less than 10 $\mu$m and with lengths of 20 $\mu$m or more, with widths of 10 $\mu$m or more and less than 20 $\mu$m and with lengths of 20 $\mu$m or more, and with widths of 20 $\mu$m or more and with lengths of 20 $\mu$m or more, and the number of the groups of inclusions and the incidence of cracks with respect to each classification were plotted in FIG. 1. It is shown in FIG. 1 that the groups of inclusions, with widths of 5 $\mu$m or more and less than 20 $\mu$m and with lengths of 20 $\mu$m or more, do not relatively influence the occurrence of cracks in drawing even if the number thereof per unit area increases.

In contrast, in the case of the groups of inclusions, with widths of 10 $\mu$m or more and less than 20 $\mu$m and with lengths of 20 $\mu$m or more, the incidence of cracks exceeds 1% when the number of the groups nearly exceeds 20/mm$^2$, and the incidence of cracks rapidly increases as the number of groups increase further. In the case of groups of inclusions, with widths of 20 $\mu$m or more and with lengths of 20 $\mu$m or more, the incidence of cracks exceeds 1% when the number of the groups nearly exceeds 5/mm$^2$, and the incidence of cracks rapidly increases as the number of groups further increase. This shows that the occurrence of cracks in drawing can be inhibited by restricting the groups of inclusions such that the groups of lining inclusions, with widths of 10 $\mu$m or more and less than 20 $\mu$m and with lengths of 20 $\mu$m or more, is 20/mm$^2$ or less, the groups of lining inclusions, with widths of 20 $\mu$m or more and with lengths of 20 $\mu$m or more, is 5/mm$^2$ or less.

Furthermore, according to the research by the inventors, it has been demonstrated that the incidence of cracks may exceed 1% when the inclusions are $Al_2O_3$ or composite inclusions of MnO and $SiO_2$ even if the number and the size of the groups of inclusions are restricted as above, and that the probability of cracks in drawing changes according to the chemical composition of the inclusions.

The number and the size of groups of inclusions in a surface layer of a material can be measured as follows. First, a surface of a material is specularly polished and then electropolished in phosphoric acid so as to facilitate distinction of inclusions. Then, the optical microscopic image of the surface is scanned by an image analyzer, and the images of inclusions are specified using the difference in the color tone between the inclusions and the matrix of the Fe—Cr—Ni alloy. Then, each image of the inclusions is enlarged 5 $\mu$m in the rolling direction and enlarged 5 $\mu$m in the transverse direction to the rolling direction, and the image is then reduced 5 $\mu$m in the respective directions. By these operations, the inclusions in the image, which exist over short distances, combined with each other into a group. Finally, the width and the length of each group of the inclusions (including single inclusions) are measure by the image analyzer.

The chemical composition of the group of inclusions is obtained by quantitative analysis with an electron beam microanalizer of ten inclusions chosen randomly.

The Fe—Cr—Ni alloy for electron gun electrodes of the invention has been made based on the above knowledge, and is characterized in comprising: 15 to 20% Cr; 9 to 15% Ni; 0.12% or less C; 0.005 to 1.0% Si; 0.005 to 2.5% Mn; 0.03% or less P; 0.0003 to 0.0100% S; 2.0% or less Mo; 0.001 to 0.2% Al; 0.003% or less O; 0.1% or less N; 0.1% or less Ti; 0.1% or less Nb; 0.1% or less V; 0.1% or less Zr; 0.05% or less Ca; 0.02% or less Mg by weight; balance Fe; and inevitable impurities; wherein when the alloy is rolled into a sheet with a thickness in the range of 0.1 to 0.7 mm, the surface portion of the sheet includes groups of lining inclusions, the number of groups with widths of 10 μm or more and less than 20 μm and with lengths of 20 μm or more is 20/mm$^2$ or less, and the number of groups with widths of 20 μm or more and with lengths of 20 μm or more is 5/mm$^2$ or less.

According to the preferred embodiment of the invention, the above Fe—Cr—Ni alloy for electron gun electrodes may be specified by the chemical composition of inclusions in $40 \geqq SiO_2 \geqq 100$, $0 \geqq Al_2O_3 \geqq 40$, and $0 \geqq MnO \geqq 30$ by atomic %.

Furthermore, the invention provides an Fe—Cr—Ni alloy sheet for electron gun electrodes obtained by rolling the above Fe—Cr—Ni alloy for electron gun electrodes to a thickness in the range of 0.1 to 0.7 mm.

In the following, the reasons for the above numerical limitations will be explained. In the following explanation, "%" means "weight %".

(Cr): Electron gun electrodes are required to be nonmagnetic, and the magnetic permeability thereof is required to be 1.005 or less to be nonmagnetic. In order to meet this requirement, the content of Cr is restricted to within the range of 15 to 20%. The Cr content is preferably in the range of 15 to 17%.

(Ni): If the content of Ni is less than 9%, magnetism is excessively imparted. If the Ni content is more than 15%, the material cost is relatively high. Hence, the Ni content is restricted to within the range of 9 to 15%.

(C): If the content of C is more than 0.12%, carbides excessively precipitate and drawing properties are inferior. Hence, the C content is restricted to 0.12% or less.

(Si): Si is added for deoxidation. If the Si content is less than 0.005%, the effect as a deoxidizer cannot be obtained. On the other hand, if the Si content is more than 1.0%, the formability is inferior. Hence, the Si content is restricted to within the range of 0.005 to 1.0%.

(Mn): Mn is added for deoxidation and formation of MnS. If the Mn content is less than 0.005%, these effects are not expected. If the Mn content is more than 2.5%, the hardness of the alloy markedly increases, whereby the drawing properties are inferior. Hence, the Mn content is restricted to within the range of 0.005 to 2.5%.

(P): If the P content is more than 0.03%, the drawing properties are very inferior. Hence, the P content is restricted to 0.03% or less.

(S): When contained in an appropriate amount, S forms MnS together with Mn, thereby inhibiting formation of burrs in press punching holes and generation of burring cracks in burring. If the S content is less than 0.0003%, such effects are not expected. If the S content is more than 0.0100%, coarse MnS is formed, whereby the drawing properties are inferior. Hence, the S content is restricted to within the range of 0.0003 to 0.0100%.

(Mo): Since Mo improves corrosion resistance, Mo may be advantageously added when special corrosion resistance is required. However, if the Mo content is more than 2.0%, the formability is inferior. Hence, the Mo content is restricted to 2.0% or less.

(Al): Al is added for deoxidation. If the Al content is less than 0.001%, the effect as a deoxidizer cannot be obtained. On the other hand, if the Al content is more than 0.2%, the formability is inferior. Hence, the Al content is restricted to within the range of 0.001 to 0.02%.

(O): When a large amount of O is contained, the amount of oxide-type inclusions increase, whereby drawing properties are inferior. Hence, the O content is restricted to 0.005% or less.

(N): If the N content is more than 0.1%, the formability is inferior. Hence, the N content is restricted to 0.1% or less.

(Ti): Ti forms carbides, sulfides, oxides and nitrides, whereby the drawing properties are inferior. Hence, the Ti content is restricted to 0.1% or less. A more preferable range for the Ti content is 0.02% or less.

(Nb): Nb forms carbides, sulfides, oxides, and nitrides, whereby the drawing properties are inferior. Hence, the Nb content is restricted to 0.1% or less. A more preferable range of the Nb content is 0.02% or less.

(V): V forms carbides and nitrides, whereby the drawing properties are inferior. Hence, the V content is restricted to 0.1% or less. A more preferable range for the V content is 0.02% or less.

(Zr): Zr forms sulfides and oxides, whereby the drawing properties are inferior. Hence, the Zr content is restricted to 0.1% or less. A more preferable range for the Zr content is 0.02% or less.

(Ca): Ca forms sulfides and oxides, whereby the drawing properties are inferior. Hence, the Ca content is restricted to 0.05% or less. A more preferable range of the Ca content is 0.01% or less.

(Mg): Mg forms oxides, whereby the drawing properties are inferior. Hence, the Mg content is restricted to 0.02% or less. A more preferable range of the Mg content is 0.005% or less.

(Number of Groups of Inclusions in Surface Layer)

If groups of lining inclusions with widths of 10 μm or more and less than 20 μm and with lengths of 20 μm or more exist at more than 20/mm$^2$ in a surface layer of a sheet, cracks in drawing readily occur, and the limitations are therefore determined. For the same reasons, the number of groups of inclusions with widths of 20 μm or more and with lengths of 20 μm or more is restricted to 5/mm$^2$.

(Composition of Inclusions)

If the amount of $Al_2O_3$ in the chemical composition of inclusions is large, cracks in drawing readily occur. Moreover, if the chemical composition of inclusions is a MnO rich composite inclusions of MnO and $SiO_2$, or alternatively, a composite inclusions of MnO and $Al_2O_3$, cracks in drawing readily occur. Therefore, the amounts of MnO and $Al_2O_3$ in the chemical composition of inclusions should be restricted. Hence, the inclusions preferably comprise $40 \geqq SiO_2 \geqq 100$, $0 \geqq Al_2O_3 \geqq 40$, and $0 MnO \geqq 30$ by atomic %.

DETAILED DESCRIPTION OF THE INVENTION

Examples

Figure 1:
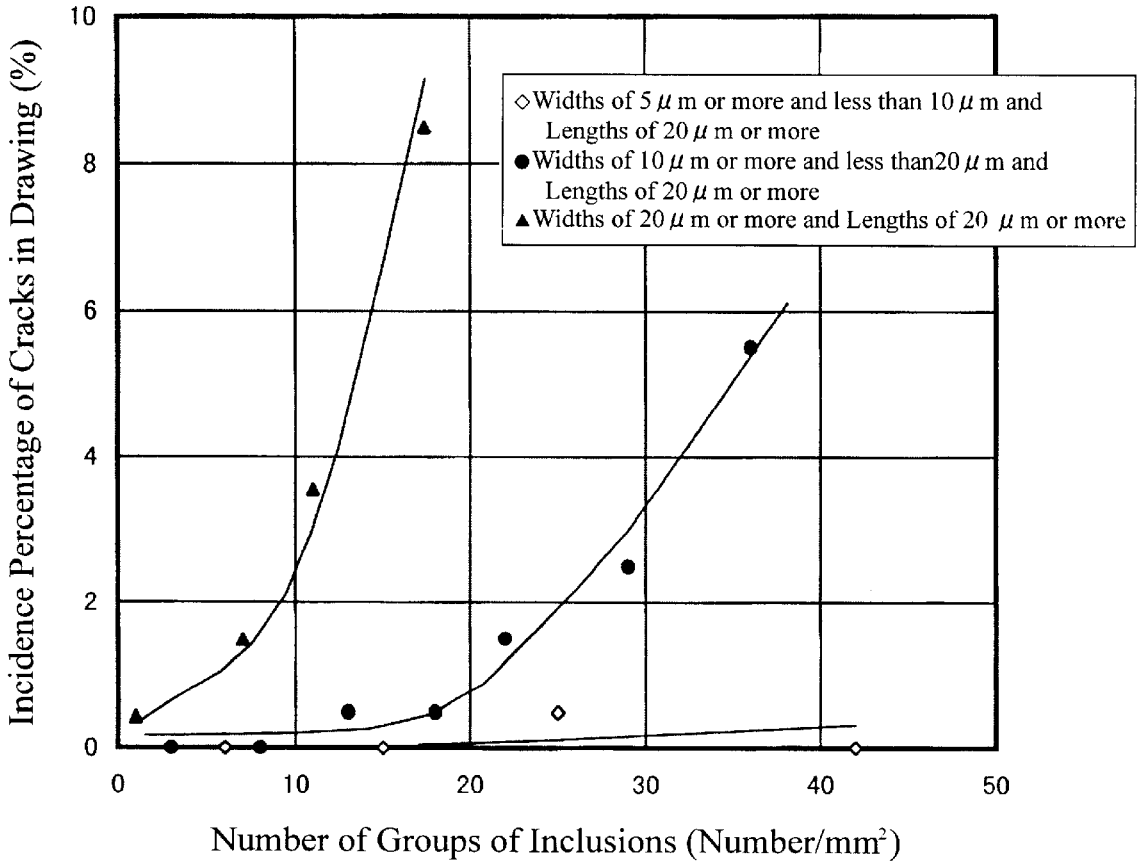
FIG. 1 is a diagram showing the relationship between the number of groups of inclusions in a surface layer of a material and the incidence of cracks in drawing.
Figure 2A:
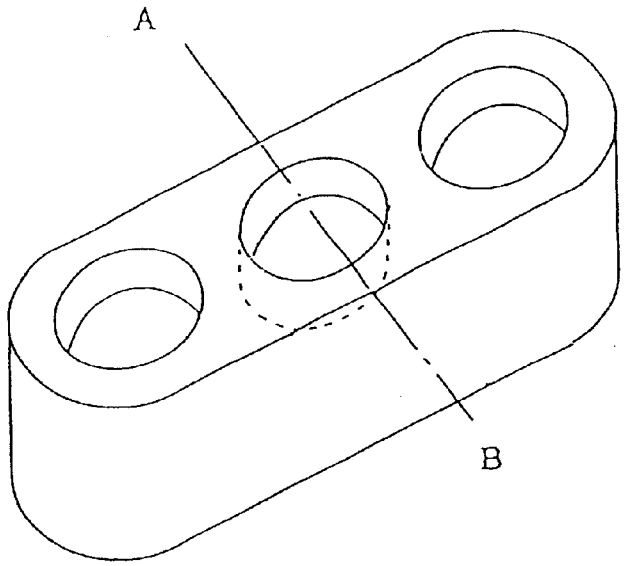
FIG. 2A is a perspective view of an electron gun electrode formed in the example of the invention.
Figure 2B:
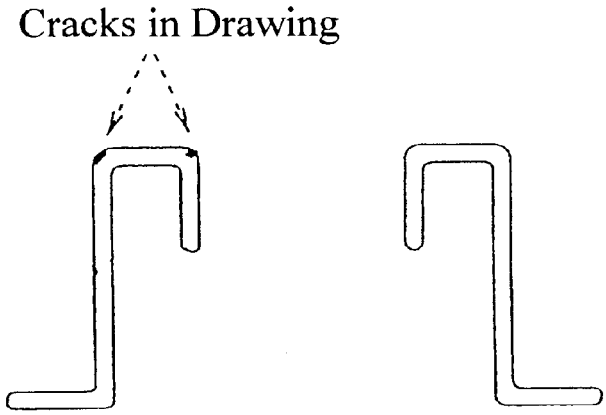
FIG. 2B is cross sectional view taken along the line A–A' in FIG. 2A.

The present invention will be explained referring to the following description of examples of the invention and comparative examples. Sample materials were melted and cast by continuous casting so as to impart the chemical compositions as shown in Table 1. In the process, in order to adjust the compositions of inclusions, Samples Nos. 5 and 8 were subjected to strong deoxidizing with Al, Samples Nos. 4 and 9 were subjected to deoxidizing with Si, Mn, and C without Al, and the other samples were subjected to deoxidizing with Si and Al. Then, samples were heated to temperatures of from 1180 to 1230° C., and they were then subjected to blooming and peeling. The samples were heated to the same temperature and were hot rolled, and they were then descaled and repeatedly cold rolled and annealed into 0.3 mm thick annealed sheets.

TABLE 1

| No. | C | Si | Mn | P | S | Ni | Cr | Cu | Al | Mo | N | O | Ca | Mg |
|---|---|---|---|---|---|---|---|---|---|---|---|---|---|---|
| 1 | 0.036 | 0.63 | 1.59 | 0.025 | 0.0034 | 14.20 | 16.11 | 0.05 | 0.0017 | 0.05 | 0.0445 | 0.0025 | 0.002 | 0.002 |
| 2 | 0.045 | 0.59 | 0.92 | 0.018 | 0.0026 | 12.28 | 17.53 | 0.08 | 0.0022 | 0.02 | 0.0250 | 0.0029 | 0.002 | 0.001 |
| 3 | 0.043 | 0.67 | 0.45 | 0.031 | 0.0052 | 14.09 | 15.77 | 0.16 | 0.0051 | 0.08 | 0.0200 | 0.0023 | 0.003 | 0.002 |
| 4 | 0.036 | 0.60 | 1.52 | 0.025 | 0.0025 | 14.07 | 15.84 | 0.04 | 0.0058 | 0.01 | 0.0360 | 0.0031 | 0.002 | 0.002 |
| 5 | 0.061 | 0.51 | 0.98 | 0.028 | 0.0035 | 13.97 | 15.77 | 0.09 | 0.0069 | 0.07 | 0.0366 | 0.0017 | 0.003 | 0.003 |
| 6 | 0.054 | 0.49 | 1.97 | 0.021 | 0.0015 | 12.19 | 16.37 | 0.19 | 0.0032 | 0.09 | 0.0437 | 0.0047 | 0.003 | 0.003 |
| 7 | 0.052 | 0.51 | 2.28 | 0.022 | 0.0017 | 12.22 | 16.30 | 0.18 | 0.0041 | 0.12 | 0.0420 | 0.0025 | 0.003 | 0.002 |
| 8 | 0.038 | 0.62 | 1.39 | 0.023 | 0.0079 | 14.28 | 16.14 | 0.06 | 0.0350 | 0.04 | 0.0445 | 0.0028 | 0.001 | 0.002 |
| 9 | 0.042 | 0.61 | 1.48 | 0.026 | 0.0013 | 14.25 | 15.84 | 0.04 | 0.0015 | 0.05 | 0.0297 | 0.0082 | 0.002 | 0.001 |

The number per unit area of groups of inclusions with widths of 10 μm or more and less than 20 μm and with lengths of 20 μm or more in the surface layer of the annealed sheet is shown in Table 2. In the tables, Samples Nos. 1 to 5 are examples of the invention, in particular, Samples Nos. 1 to 3 relate to an aspect of the invention. Samples Nos. 6 to 9 are comparative examples. Although $SiO_2$, $AlO_3$, and MnO are shown in Table 2 as inclusions included in the annealed sheet, inclusions other than these three types may be included.

TABLE 2

| No. | Number of Groups of Inclusions with Widths of 10 μm or more and less than 20 μm and Lengths of 20 μm or more (Number/mm²) | Number of Groups of Inclusions with Widths of 20 μm or more and Lengths of 20 μm or more (Number/mm²) | Compositions of Inclusions (at %) $SiO_2$ | $Al_2O_3$ | MnO | Incidence of Cracks in Drawing (%) | |
|---|---|---|---|---|---|---|---|
| 1 | 3 | 0 | 45~52 | 12~18 | 18~26 | 0.0 | Example of the Invention |
| 2 | 11 | 0 | 52~58 | 21~27 | <1 | 0.0 | |
| 3 | 18 | 2 | >98 | <1 | <1 | 0.5 | |
| 4 | 12 | 0 | 48~52 | <3 | 44~49 | 1.0 | |
| 5 | 10 | 0 | ≦1 | 86~89 | 11~14 | 1.0 | |
| 6 | 22 | 3 | 45~55 | 21~27 | 18~21 | 2.5 | Comparative Example |
| 7 | 32 | 7 | >97 | <1 | <1 | 5.5 | |
| 8 | 17 | 6 | ≦1 | ≧99 | <1 | 3.5 | |
| 9 | 25 | 9 | 48~68 | <1 | 32~51 | 5.5 | |

The annealed sheets were worked into products with a hole of 6 mm diameter and a burring height of 2 mm, and cracks were inspected in 200 pieces sampled at random from 2000 pieces. The incidence of cracks is shown in Table 2.

As is clearly shown in Table 2, in all the Samples Nos. 1 to 5, the incidence of cracks in drawing was small compared to the Comparative Examples Nos. 6 to 9, and demonstrated superior drawing properties. In Samples Nos. 4 and 5 among these, which relates to an aspect of the invention (the number of groups of inclusions) which differs from the particular aspect mentioned above (chemical composition of the inclusions), the incidence of cracks was relatively large compared to Sample No. 2 in which the number of groups of inclusions was almost the same. In Samples Nos. 6 to 9, since the number of groups of inclusions was large, the incidence of cracks in drawing was large.

As is explained in the above, in the Fe—Cr—Ni alloy for electron gun electrodes, drawing properties can be extremely improved, and cracks in drawing can be reduced even if press working is performed in severe condition, and it the Fe—Cr—Ni alloy is very useful for electron gun electrodes.

What is claimed is:

1. An Fe—Cr—Ni alloy sheet for electron gun electrodes, wherein the sheet is obtained by rolling an Fe—Cr—Ni alloy comprising: 15 to 20% Cr; 9 to 15% Ni; 0.12% or less C; 0.005 to 1.0% Si; 0.005 to 2.5% Mn; 0.03% or less P; 0.0003 to 0.0100% S; 2.0% or less Mo; 0.001 to 0.2% Al; 0.0005% or less O; 0.1% or less N; 0.1% or less Ti; 0.1% or less Nb; 0.1% or less V; 0.1% or less Zr; 0.05% or less Ca; 0.02% or less Mg by weight; balance Fe; and inevitable impurities;

wherein the alloy is rolled into a sheet with a thickness in the range of 0.1 to 0.7 mm, the surface layer of the sheet includes groups of lining inclusions, the number of groups with widths of 10 μm or more and less than 20 μm and with lengths of 20 μm or more is 20/mm² or less, and the number of groups with widths of 20 μm or more and with lengths of 20 μm or more is 5/mm² or less.

2. An Fe—Cr—Ni alloy sheet for electron gun electrodes, according to claim 1, wherein the groups of lining inclusions in the surface layer comprise $40 \leqq SiO_2 \leqq 100$, $0 \leqq Al_2O_3 \leqq 40$, and $0 \leqq MnO \leqq 30$ by atomic %.

3. An Fe—Cr—Ni alloy sheet for electron gun electrodes, according to claim 1, wherein the Cr content is in the range of 15 to 17% by weight.

4. An Fe—Cr—Ni alloy sheet for electron gun electrodes, according to claim 1, wherein the content of at least Ti, Nb, V, and Zr is 0.02% or less by weight.

5. An Fe—Cr—Ni alloy sheet for electron gun electrodes, according to claim 1, wherein the Ca content is 0.01% or less by weight.

6. An Fe—Cr—Ni alloy sheet for electron gun electrodes, according to claim 1, wherein the Mg content is 0.005% or less by weight.

* * * * *